United States Patent [19]

Bunzl

[11] 4,438,594

[45] Mar. 27, 1984

[54] BALANCED SLIDING DOOR STRUCTURE

[75] Inventor: Helmut H. Bunzl, Zumikon, Switzerland

[73] Assignee: AG für Türautomaten, Dübendorf, Switzerland

[21] Appl. No.: 337,588

[22] Filed: Jan. 7, 1982

[30] Foreign Application Priority Data

Jan. 21, 1981 [DE] Fed. Rep. of Germany ..... 3101725

[51] Int. Cl.[3] ..... E05D 15/22

[52] U.S. Cl. ..... 49/177; 49/125; 49/184; 49/396; 49/411

[58] Field of Search ..... 49/125, 260, 177, 184, 49/183, 409, 411, 396

[56] References Cited

U.S. PATENT DOCUMENTS

| | | | |
|---|---|---|---|
| 978,768 | 12/1910 | Marshall | 49/184 X |
| 1,049,224 | 12/1912 | Gehri | 49/184 |
| 3,266,189 | 8/1966 | Eby | 49/257 X |
| 3,300,897 | 1/1967 | Wikkerink | 49/177 X |
| 3,466,805 | 9/1969 | Muessel | 49/177 X |
| 3,750,334 | 8/1973 | Slaybaugh | 49/396 X |

*Primary Examiner*—Philip C. Kannan

*Attorney, Agent, or Firm*—Frishauf, Holtz, Goodman, Woodward

[57] ABSTRACT

To permit swinging movement of the door panel (2*a*) about vertical hinges (8) of a sliding door (2), suspended from hangers (13) running on a roller track (9, 19), without tilting or twisting of a vertical frame member (11) of the door, and in which a horizontal frame member (10) is secured to the hangers (13), a massive metallic angle (12) is inserted in the horizontal and vertical frame members and prestressed by engagement of a tension bolt (15) with the angle (12) in the horizontal frame element to provide a counteracting force on the vertical frame element (11) when the door panel (2*a*) is unhooked from the horizontal element (12) to permit swinging movement.

12 Claims, 7 Drawing Figures

BALANCED SLIDING DOOR STRUCTURE

The present invention relates to a sliding door structure, and more particularly to a structure in which a pair of sliding doors are suspended from an overhead track, guided in a floor track, and in which the doors themselves have door wings or panels which can be swung open independently of sliding movement of the entire door on the track.

BACKGROUND

Various types of track-suspended door structures are known, and the referenced U.S. Pat. No. 3,266,189, Eby, shows a typical power-operated arrangement. It is known to so arrange sliding doors that the doors can move not only in direction of a suspension track, for example in a straight line to and from each other, but additionally include panel members which are arranged for swinging movement transverse to the direction of sliding movement. Such additional swinging movement is desirable particularly in installations where a maximum panel opening is desired, for example to permit a large number of people to rapidly leave a building, or to provide an opening of increased width for vehicular traffic. Sliding doors which are so arranged cause difficulties, however, since swinging movement of the door panels or door elements of sliding doors does not permit attaching of hinges about which the doors can swing to a fixed frame. Since the attachment point for the hinges, themselves, are movable and, for swinging movement the doors can no longer be supported along their width from the top, for example, the hinge attachment on a sliding frame portion will shift, causing the door, as it swings, to bind against a floor structure. It is customary to provide sliding doors with a downwardly projecting guide element, typically a bolt, or the like, which slides in a guide track or rail. This bolt, however, is movable longitudinally in a sliding direction and will shift its position upon release of a swinging door element from the sliding door structure, so that it is suspended only on the hinges, due to the force moment which the door exerts on the hinge structure. It is undesirable to foreshorten the door so that the tilting of the door frame, upon swinging movement of the door, is compensated, since, then, when the door is closed, a gap will permit exchange of heated or cooled air, and otherwise interfere with the purposes of a door, which is to close off an opening. Constructing the door frame in such a manner that its mass is substantially greater than that of the door structure is undesirable due to costs, power requirements in sliding the door open, and the like.

THE INVENTION

It is an object to provide a sliding door structure which permits swinging movement of a door element thereof, with minimum gap or play at the floor, and in which the tendency of the door to sag, as it is opened, is counteracted.

Briefly, the door frame has a horizontal frame element and a vertical frame element, the horizonal frame element being suitably suspended on an overhead support rail. The door element is secured by hinges to the vertical frame element, and releasably attached to the horizontal frame element. Upon release of the door element from the vertical element, it can swing about the hinges secured thereto. To prevent shifting of the vertical frame element under the weight of the door which, then, no longer is suspended also from the horizontal frame element, a prestressing structure is included in the frame to connect the frame elements together and to provide a prestressing force which counteracts the force component exerted by the door element on the vertical frame element. Such a prestressing structure, for example, is a metal angle which is stressed by a holding bolt extending in vertical direction to exert a tilting moment on the vertical frame element which counteracts the moment applied by the door element when it is unlatched from the horizontal frame element.

The structure has the advantage that the prestressing arrangement results in maintenance of the vertical position of the vertical frame element even if the weight of the door exerts a twisting moment thereon. The door element which can swing, thus, can be pivoted about a vertical axis without dragging on, or sagging against an adjacent floor. This is possible at any sliding position of the door, and not only at a terminal or end position where the vertical frame element can be secured or backed up against a fixed support. Thus, the sliding movement of the entire door structure becomes independent of the particular position of the door element or door panel—which, of course, may be a composite structure.

DRAWINGS

Figure 1:
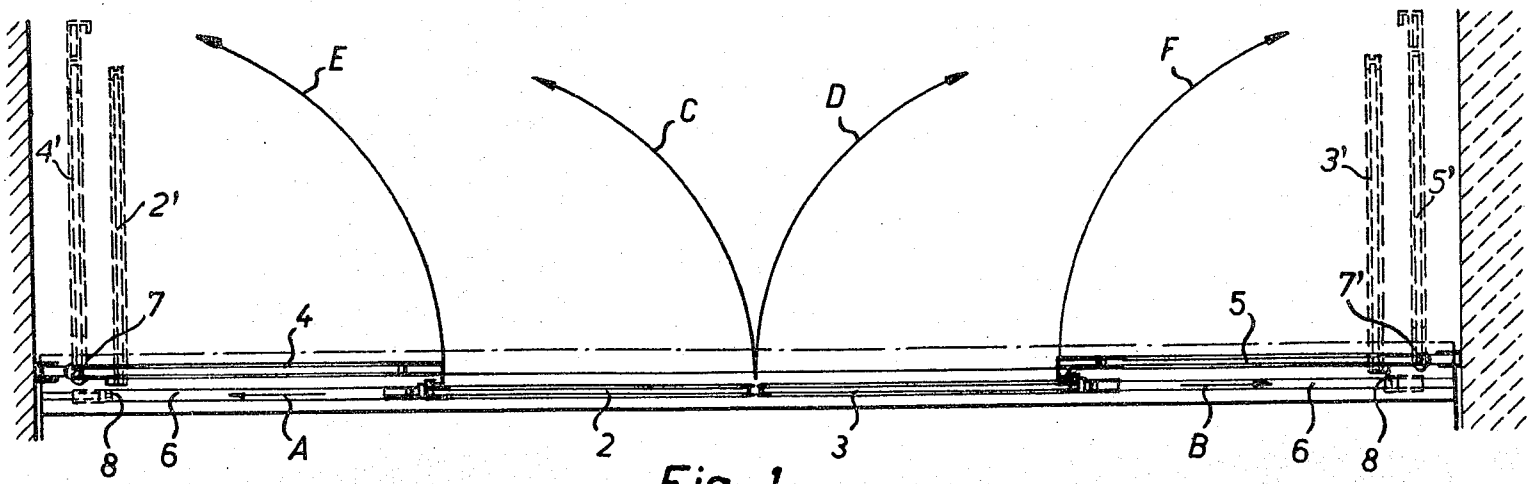
FIG. 1 is a schematic top view of a dual track four-wing sliding door structure in which the respective wings can be pivoted, and two oppositely directed wings can be moved in sliding direction on a track as well as pivoted.
Figure 3:
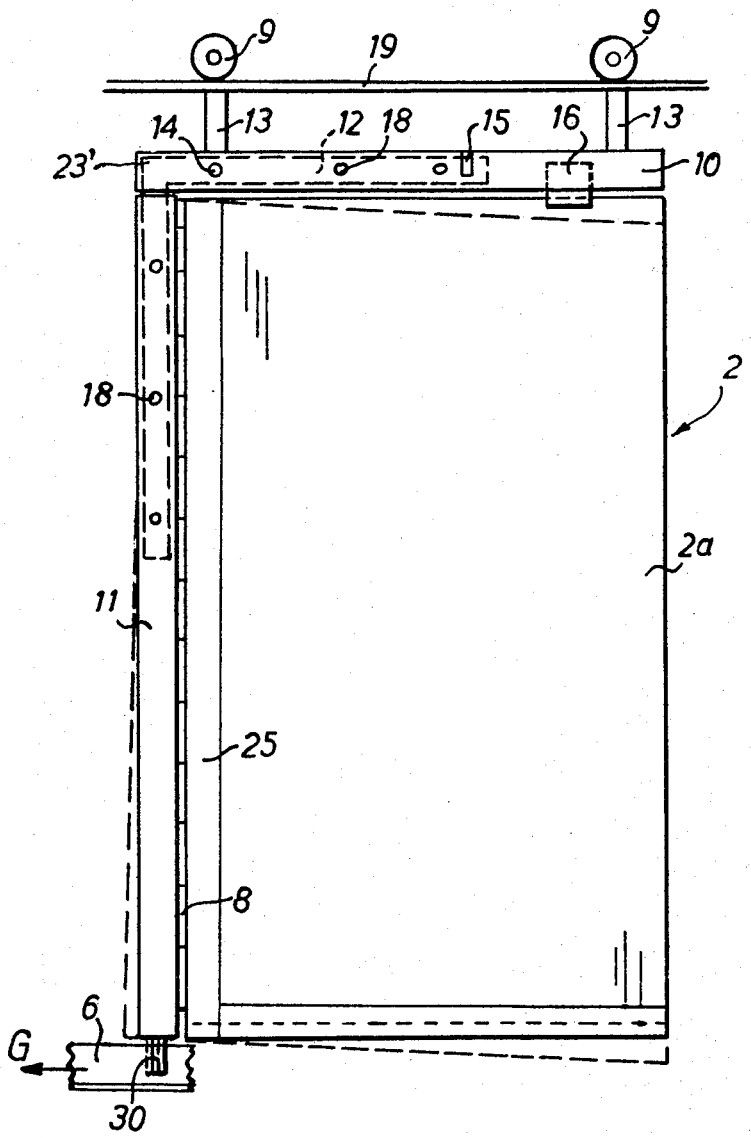
FIG. 3 is a schematic front view of a door secured to the guide track and suspended therefrom.

The overall door system has two sliding doors 2, 3 which are suspended from an upper support rail 19—see FIGS. 1 and 3—and guided in a lower guide track 6. The doors 2, 3 are secured to support brackets 13 which, in turn, are attached to a roller or roller assembly 9. The support brackets 13 and the rollers 9 may be constructed in any conventional and suitable form and, therefore, are shown only schematically. The two sliding doors 2, 3 can be moved—as known and by any suitable means—towards and away from each other in the direction of the arrows A, B—see FIG. 1—to expose an entry opening defined by lateral wings 4, 5. In addition to the sliding movement in the direction of the arrows A, B, the doors 2, 3 or, rather, door elements or panels thereof, can be moved in pivoting direction in accordance with the arrows C, D, for example towards the outside of a building structure, shown only schematically. The two lateral wings 4, 5 can swing over vertical pivot axes 7, 7' so that they can assume the positions shown in broken lines at 4', 5' in FIG. 1. In normal condition, the doors 4, 5 are in their full-line position; they are opened only if the entrance opening is to be enlarged, for example to permit rapid evacuation of a building, passage of a wide vehicle, or the like, or, in general, if the opening defined merely by the doors 2, 3 should be insufficient. Under ordinary conditions, the doors 4, 5 are maintained in the position shown in solid lines by springs or the like, which may include security latches; upon release of the latches, and overcoming of spring force, the wings 4, 5 can escape from their normal position to be pivoted in the direction of the arrows E, F to the broken-line positions 4', 5'. The sliding doors 2, 3 can be pivoted in the direction of the arrows C, D at any one selected sliding position of the doors along the tracks, for example to be moved in the broken-line positions shown in FIG. 1 at 2', 3' when the doors are pivoted at their terminal positions; they may, however, also be opened at any intermediate location along the length of the track.

The doors 2, 3 are mirror-symmetrical, and the invention will be described in relation to door 2 only. The doors 2, 3 have a frame formed, each, by a vertical frame element 11 and a horizontal frame element 10. The horizontal frame element is suspended via the hangers 13 on the rollers or trolleys 9, as shown, so that the horizontal frame element 10 is supported along the length thereof. The vertical frame element is guided in the lower rail 6 by a bolt 30. The door 2 additionally includes a door element or panel **2*a*. The door element 2*a* is shown as a solid panel but, of course, may be a multi-panel or other suitable structure, for example made of glass or other material; the reference to "door panel" herein, thus, is intended to apply to any suitable structure which has the function of a door panel. The door panel 2*a* is secured to the frame 11 along the vertical axis by a hinge 8 which, preferably, is a piano-type hinge extending along the length of the vertical frame structure 11. In addition, the door panel 2*a* is supported at the side remote from the hinge by a support hanger 16—see also FIG. 5—so that the weight of the door panel 2*a* is transferred to the horizontal frame member 10 for support from the hangers 13, rollers 9 and the upper support rails 19**.

Figure 4:
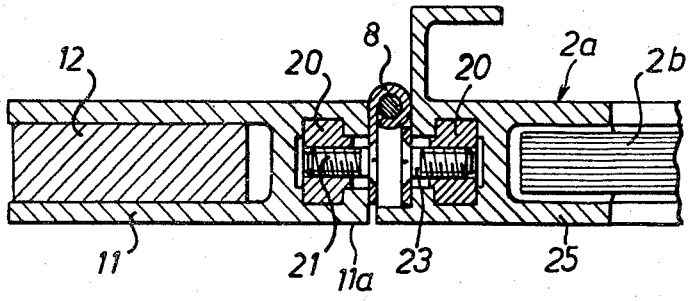
FIG. 4 is a cross section, to an enlarged scale, along section line IV—IV of FIG. 2.
Figure 5:
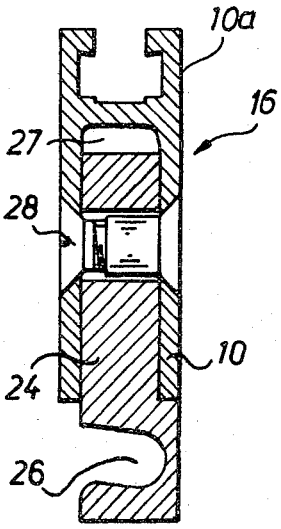
FIG. 5 is a section along line V—V of FIG. 2.

The frame elements 10, 11 may be solid; in a preferred form, however, and as shown, they are formed as profiled rails—see FIGS. 4, 5—to permit receiving filler strips or insert elements therebetween. The hanger 16 form such an insert element, and includes a block-like plate 24 formed with a slit, notch or groove 26 therein, to be engaged by a suitable bail (not shown) attached to the door panel **2*a* to hook into the hook-like portion of the block 24 beneath the groove or slit 26. This attachment arrangement can be standard, and any other suitable arrangement may be used which provides for secure attachment of the door panel 2*a* to the frame element 10 while transferring vertical loading forces to the frame element 10. The block or plate 24 is secured to the frame element 10 by a through-bolt 28. Preferably, the frame element 10 is identical to the frame element 11, and thus is formed with an extending portion 10*a* which can be used to receive a T-like hanger or a bolt head forming the hanger structure 13, or attaching a separate hanger 13 to the rail 10**.

The hinge 8, preferably an extended or "piano" hinge, is secured to the frame element 11 and to the door panel element **2*a*, as best seen in FIG. 4, by engaging screws 21 in insert head plates 20 which are slid into the end portion 11*a* of the frame element 11. Similarly, the counter hinge part attached to the door panel 2*a* is secured by bolts 23, likewise screwed into holding plates or elements 20 slipped behind a reentrant portion of a rail structure 25. The rail structure 25 may be identical to the rail 10, 11, or be formed with projecting strips to provide end stops, gripping surfaces and the like, as desired. The rails 25 retain the panel 2*b* which forms the door panel itself; the panel may, for example, be a glass plate or a series of glass plates separated from each other by suitable holding strips to which the glass panels themselves are secured in customary manner. The frame elements 10, 11, 25** may be made of any suitable material, such as steel or aluminum.

Operation

For normal operation, and with the door panels **2*a* in the full-line position shown in FIG. 1, the doors 2, 3 can be moved along the support rail 19 in accordance with the layout of the rail 19. In order to permit pivoting movement of the door panel 2*a* about a vertical axis, it is released from the hanger 16. Upon such release, the weight of the door is no longer uniformly suspended across its width, but only at one side, so that a force moment will be exerted on the vertical frame 11. If the door panel 2*a* is heavy, for example if, in accordance with a preferred embodiment, it is made of glass, the vertical frame portion will have the tendency to deflect, so that, absent the structure of the present invention, the door would assume the position shown in broken lines in FIG. 3. The deflection of the vertical frame structure 11 cannot be prevented by the lower bolt 13 since the lower bolt 13, engaging the rail or track 6, of course, is longitudinally slidable therein to follow the movement of the door along the upper support rail 19. The lower bolt 30 thus cannot laterally support the door 11 as soon as it is released from the hanger 16, nor can it prevent deflection of vertical frame member 11, which is inevitable due to the moment which arises. The left support roller or trolley 9—with respect to FIG. 3—may lift somewhat off the track. Restraining such movement is usually no solution since in such structures sufficient clearance must be provided for ease of movement, and even a small deflection of the left roller 9 is magnified by the usual width of the door panel 2*a*. The bolt 30 is free to move in the direction of the arrow G—FIG. 3—which, of course, is parallel to the arrow A of FIG. 1. The usual support by the rollers 9 and hangers 13 of the horizontal frame element 10 is close to the ends thereof—as shown—and thus deflection of the vertical member 11 is the usual result of unlatching the door panel 2*a* from the support 16**.

In accordance with the present invention, and to prevent that the door—overall—will deflect to the position shown in broken line in FIG. 3, and the deflected position of the vertical member 11 then cause dragging of the door along the ground surface, a massive metal angle element 12 is inserted in the frame elements 10, 11, and arranged to provide a prestressing force which opposes the weight of the door when it is unlatched from the hanger 16.

Figure 2:
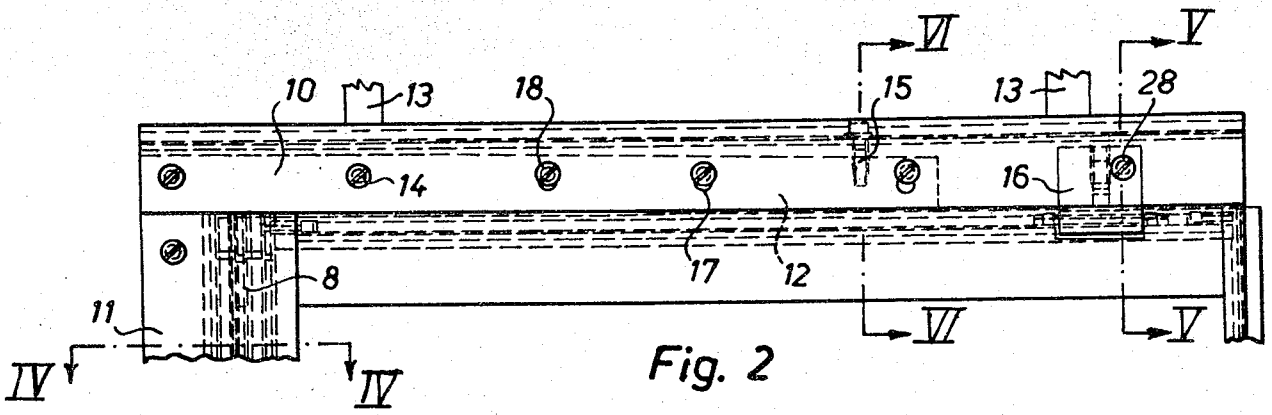
FIG. 2 is a fragmentary side view, to an enlarged scale, of the frame of one of the doors.
Figure 6:
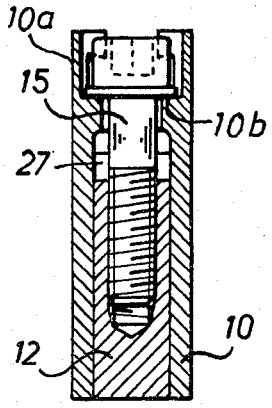
FIG. 6 is a section along line VI—VI of FIG. 2.

The angle 12 is secured to the horizontal frame member 10 by a screw or bolt 14 located close to or at the corner region 23 of the angle 12. The screw need not be positioned precisely at the corner, but can be positioned somewhat inwardly, for example in at least approximate alignment with the hanger 13 suspending the frame 10 from roller 9 close to the corner region 23. The bolt 14 forms a pivot axis or fulcrum which permits slight relative motion of the angle 12 with respect to the horizontal and the vertical frame portions 10, 11. The angle 12 is secured to the horizontal frame element 10 by a tension bolt 15—see FIG. 6. The tension bolt 15 engages a shoulder **10*b* of the end portion 10*a* of the frame 10 and is threaded into the angle 12. Upon tightening of the tension bolt 15 into the angle 12, the angle will prestress and apply a force against the vertical frame portion 11 which is directed opposite the moment applied by the door panel 2a when it is pivoted about the hinge 8. The angle 12 can slightly rock about the screw 14 forming a fulcrum point. If the screw 14 is positioned in approximately alignment with the hanger 13—for example as shown in FIG. 2—prestressing the frame 12 will also maintain the roller 9 adjacent the corner region 23' of the door in contact with the upper support rail 19. To permit slight movement of the angle 12 with respect to the frame members 10, 11, elongated holes 17 (FIG. 2) are provided which, after tensioning bolt 15, can be used to pass bolts 18 therethrough and secure the angle 12 in position in the frame members. Bolts 18 are tightened after the bolt 15** has been turned to provide the proper bias force to prestress the frame.

The arrangement is simple and inexpensive, and provides for maintenance of the vertical portion in exactly vertical position even if the door panel 2a, or, of course, in the mirror-symmetrical arrangement with respect to door 3, a similar panel element is released from the hanger 16 so that the panel is held only on the vertical hinge 8 secured to the vertical frame element 11.

Figure 7:
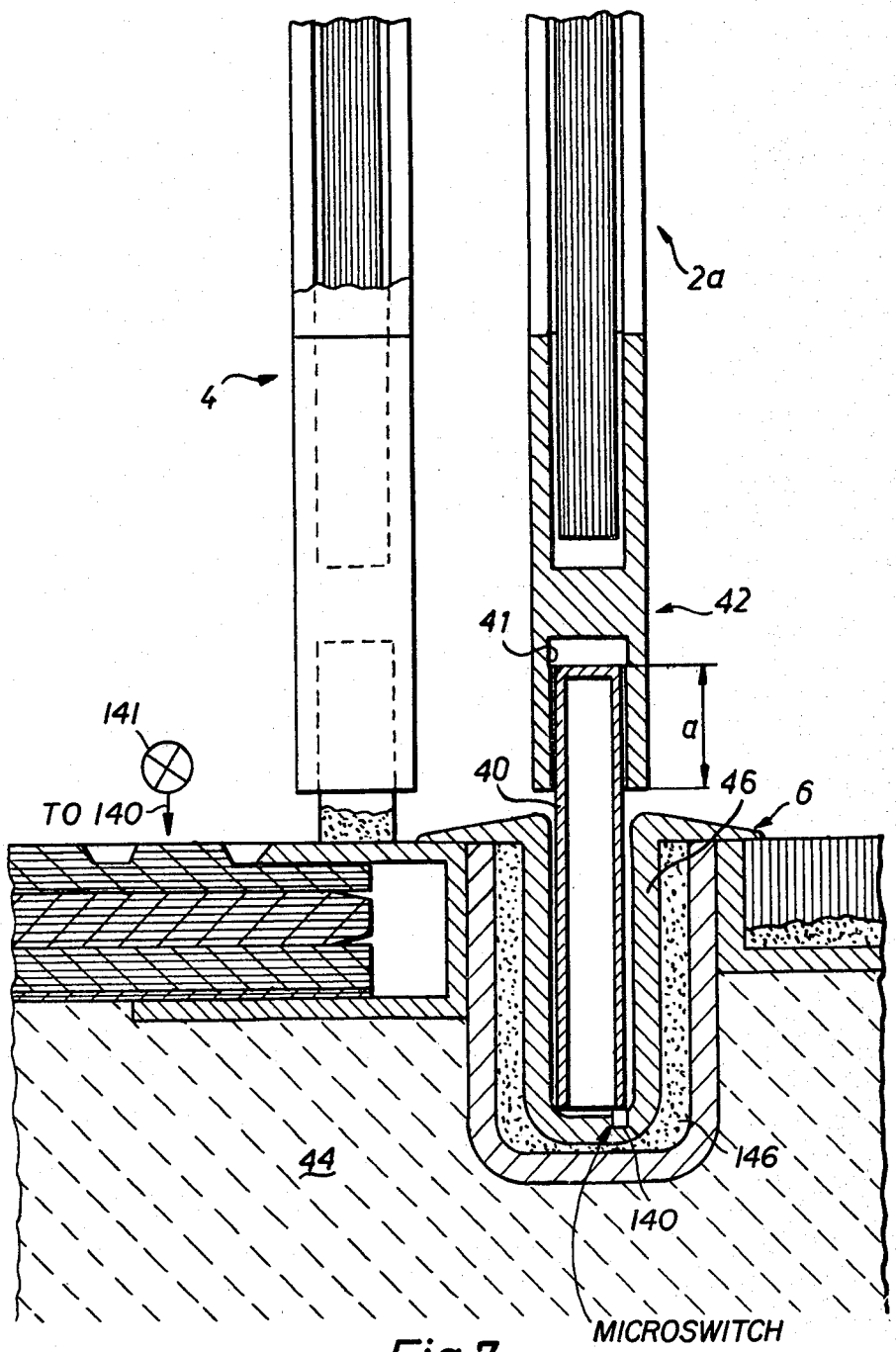
FIG. 7 is a vertical sectional view through the lower portion of a door structure and also illustrating a modifying lower rail.

Security arrangement: Since the door panel 2a can swing freely, unauthorized opening is preferably prevented not only by locks applied, for example, at matching portions of the doors 2, 3, but additionally by preventing swinging movement of the door panels along the arrows C, D—FIG. 1—as such. The security arrangement is so constructed that the doors can be moved horizontally along the direction of the support rail 19, for example, which movement can readily be prevented by suitable lock structures, if undesired, but are positively inhibited from swinging movement. Referring to FIG. 7, a safety rail 40 is provided which engages an open rail portion on a lower frame element 42 of the door panel 2a. The lower rail 6, shown only schematically in FIGS. 1 and 3, is shown in detail in FIG. 7 and includes, preferably, a recessed track 46 which, for example, can be a profiled metal element set into a concrete trough 146 or the like in the floor structure 44 of the building, or an adjacent platform. The safety element 40 is an elongated rail, for example made of aluminum, of channel or U-shaped cross section—see FIG. 7—and loosely seated in the lower track 46 which also forms the sill for the door, inserted, for example, by hand. It should be sufficiently tall to fit by a suitable distance a into an open groove 41, or matching channel structure of the lower frame 42 of the door panel 2a. The safety rail 40, which fits into the track 46, has a length which is somewhat longer than the sliding path of any one of the sliding doors 2, 3 to insure that swinging movement is positively prevented even if the swinging door is in its widest open position. The dimension a with which the safety rail 40 engages groove 41 should be at least as long as the thickness of the safety rail 40. This insures that the rail is sufficiently resistant to shearing forces, and unauthorized tampering or forcing of the door. Making the rail 40 slightly longer than the movement path of the doors 2, 3 also provides optical indication that the rail 40 has been inserted into the bottom track, and should be removed during normal operating hours, in which the sliding door should be permitted to pivot. The rail 40 does not interfere with sliding movement of the door in the directions of the arrows A and B.

The inserted or removed position of the security rail 40 can easily be monitored by placing, for example, a microswitch 140 or similar small weight-controlled switch somewhere along the length of the lower track 6, recessed for example within the lower track 46, and connected to a suitable monitoring lamp 141 which indicates whether weight is applied on the switch by the rail 40, thus its presence, or if the switch is unloaded, and thus its absence. Of course, other suitable indicators may be used, such as normally storing the rail, when not inserted, in a predetermined position, for example with contrasting color arrangements to immediately determine presence or absence of the rail from storage.

Various changes and modifications may be made within the scope of the inventive concept.

I claim:

1. Balanced sliding door structure having an upper support rail (19), a lower guide track (6, 46), at least one sliding door (2, 3) suspended from the support rail and having a lower guide element (30) engaging lower guide track, the door including a door frame (10, 11) and a swing door panel (2a) hinged to the frame and movable about a vertical swing axis, wherein, the door frame includes a horizontal frame element (10) suspended from the support rail, and a vertical frame element (11) secured thereto and carrying said lower guide element (30);

a hinge means (8) secured to the vertical frame element and to the door element to permit relative swinging movement of the door element with respect to the frame and thus permit relative sliding of the entire door along the rail as well as swinging of the door element;

and means are provided for prestressing the vertical frame element (11) with respect to the horizontal frame element (10) to balance the weight of the door element when supported only by the hinge means (8), comprising a metal angle (12) having a corner (23') positioned in the vicinity of the hinge means (8) secured to both said frame elements (10, 11) and applying a force component thereon which is counter the weight of the door element as applied to the vertical frame element by the hinge means, said angle (12) being fitted in the horizontal frame element (10) and secured to the frame by a fulcrum or pivot bolt (14) positioned adjacent the corner region (23) of the angle.

2. Structure according to claim 1, further including a force-applying bolt (15) connecting the angle (12) and the horizontal frame element (10) and applying a force between said angle and the horizontal frame element which acts through the angle on the vertical frame element (11) to counteract the moment exerted by the weight of the swing door panel on the hinge means (8).

3. Structure according to claim 2, wherein the angle (12) has one leg secured to and in engagement with the horizontal frame element (10) and another leg extending perpendicularly thereto secured to and in engagement with the vertical frame element (11).

4. Structure according to claim 1, further including support means (16) secured to the swing door panel and to the horizontal frame element (10) adjacent the end of the door panel remote from the hinge means to support the door panel, selectively, in latched position across its width, but permit unlatching and swinging about the hinge means.

5. Structure according to claim 1, wherein two doors (2, 3) are provided, movable in a single upper support rail and lower guide track;

and a further pair of pivotable door wings (4, 5) are provided, positioned for swinging movement only adjacent the ends of the support rail and the guide track.

6. Structure according to claim 1, wherein the lower guide track comprises a U-shaped element open towards the top;

the lower guide element (30) comprises an engagement projection, extending from the bottom of the vertical frame element (11);

the door panel includes a lower frame profile rail (42) having a longitudinally extending internal groove (41);

and further including a security bar or rail (40) insertable in the open U of the support rail and fitting within the groove of the rail profile of the door panel to prevent pivoting or swinging movement of the door panel upon engagement with the security bar or rail, while permitting sliding movement with respect thereto, the length of the security bar or rail being longer than the path of movement of the door on the support rail.

7. Structure according to claim 6, further including means sensing the presence or absence of the security bar or rail in the U-shaped guide track (6, 46).

8. Balanced door structure adapted to be positioned above a door level or sill having an upper support rail (19);

a lower guide track (6, 46);

at least one sliding door (2, 3) suspended from the support rail and having a lower guide element (30) engaging the lower guide track, the door including a door frame (10, 11) and a swing door panel (2a) hinged to the frame and movable about a vertical swing axis;

wherein the lower guide track comprises a U-shaped element open towards the top and recessed within said sill;

the door frame includes a horizontal frame element (10) suspended from the support rail, and a vertical frame element (11) secured thereto and carrying said lower guide element (30);

a hinge means (8) secured to the vertical frame element and to the door element to permit relative swinging movement of the door element with respect to the frame and thus permit relative sliding of the entire door along the rail as well as swinging of the door element;

and means are provided for prestressing the vertical frame element (11) with respect to the horizontal frame element (10) to balance the weight of the door element when supported only by the hinge means (8), comprising a prestressing element (12) secured to both said frame elements (10, 11) and applying a force component thereon which is counter the weight of the door element as applied to the vertical frame element by the hinge means, wherein the lower guide element (30) comprises an engagement projection, extending from the bottom of the vertical frame element (11);

the door panel includes a lower frame profile rail (42) having a longitudinally extending internal groove (41);

a security bar or rail (40) insertable in the open U of the support rail and fitting within the groove of the rail profile of the door panel to prevent pivoting or swinging movement of the door panel upon engagement with the security bar or rail, while permitting sliding movement with respect thereto, the length of the security bar or rail being longer than the path of movement of the door on the support rail;

and means for sensing the presence or absence of the security bar or rail in the U-shaped guide track (6, 46).

9. Structure according to claim 8, further including electrical switch means (140) located in the bottom of the U-shaped element and operable by the weight of the security bar or rail (40) to change switching state upon detecting of the weight of said security bar or rail and thereby providing an output indication of the presence or absence of said security bar or rail.

10. Structure according to claim 8, wherein said security bar or rail (40) comprises an elongated element having channel or U-shaped cross section, loosely seated in the lower guide track.

11. Structure according to claim 8, wherein said sill comprises a concrete, or cement structure (146) into which said lower guide track is placed.

12. Structure according to claim 11, wherein said security bar or rail (40) comprises an elongated element having channel or U-shaped cross section, loosely seated in the lower guide track.

* * * * *